US007596889B2

(12) United States Patent
Pasternak et al.

(10) Patent No.: US 7,596,889 B2
(45) **Date of Patent: *Oct. 6, 2009**

(54) FOOTWEAR OUTSOLE INCLUDING STAR SHAPES

(75) Inventors: Stephen M. Pasternak, Englewood, FL (US); Jamie Joe Zimmer, Hudson, WI (US)

(73) Assignee: Red Wing Shoe Company, Inc., Red Wing, MN (US)

( * ) Notice: Subject to any disclaimer, the term of this patent is extended or adjusted under 35 U.S.C. 154(b) by 1 day.

This patent is subject to a terminal disclaimer.

(21) Appl. No.: 11/588,449

(22) Filed: Oct. 27, 2006

(65) Prior Publication Data

US 2007/0039206 A1 Feb. 22, 2007

Related U.S. Application Data

(63) Continuation of application No. 10/903,892, filed on Jul. 30, 2004, now Pat. No. 7,146,752.

(51) Int. Cl.
*A43C 15/02* (2006.01)

(52) U.S. Cl. ..... 36/59 R; 36/59 C

(58) Field of Classification Search ..... 36/59 R, 36/59 C, 128, 126; D2/951, 957, 958, 959, D2/952, 967

See application file for complete search history.

(56) References Cited

U.S. PATENT DOCUMENTS

| | | | |
|---|---|---|---|
| 322,224 | A | 7/1885 | Watkinson |
| 354,693 | A | 12/1886 | Dick |
| 989,514 | A | 4/1911 | Sanford |
| D51,644 | S | 1/1918 | Johnson |
| D57,874 | S | 5/1921 | Trimboli |
| 1,650,446 | A | 11/1927 | Righter |
| D81,915 | S | 9/1930 | Burchfield |
| 1,979,391 | A | 11/1934 | Laybolt |

(Continued)

FOREIGN PATENT DOCUMENTS

DE 27 13 142 A1 10/1978

(Continued)

OTHER PUBLICATIONS

"Knapp Boots & Shoes," http://www.knappshoes.com/, 3 pages (Copyright 2002).

(Continued)

*Primary Examiner*—Ted Kavanaugh
(74) *Attorney, Agent, or Firm*—Merchant & Gould P.C.

(57) ABSTRACT

A footwear outsole includes a base portion defining a tread attachment surface, and a plurality of tread members. The tread members are coupled to the tread attachment surface and protrude away from the tread attachment surface to define a tread member height. Each tread member includes a plurality of pointed arm members that extend away from a center portion of the tread member in a direction substantially parallel to a plane of the attachment surface. The arm members include a pointed tip that defines a maximum height of each tread member. The tread members include a primary surface facing away from the tread attachment surface. The primary surface includes a recessed portion that is reduced in height from the height of the plurality of edges. The tread members may be arranged in a pattern across the tread attachment surface.

22 Claims, 8 Drawing Sheets

U.S. PATENT DOCUMENTS

| | | | | | |
|---|---|---|---|---|---|
| D117,831 | S | | 11/1939 | Johnson | |
| D119,266 | S | | 3/1940 | Johnson | |
| 2,424,463 | A | | 7/1947 | Hogg | |
| D149,698 | S | * | 5/1948 | Shaffer et al. | D2/952 |
| 2,580,840 | A | | 1/1952 | Rogndal | |
| 3,063,171 | A | * | 11/1962 | Hollander | 36/59 R |
| D196,490 | S | | 10/1963 | Papoutsy | |
| D200,091 | S | * | 1/1965 | Meredith | D2/952 |
| D201,864 | S | | 8/1965 | Smith, III | |
| 3,555,697 | A | | 1/1971 | Dassler | |
| 3,793,750 | A | | 2/1974 | Bowerman | |
| 4,069,601 | A | | 1/1978 | Robbins et al. | |
| D259,823 | S | | 7/1981 | Greenlee | |
| 4,283,865 | A | * | 8/1981 | Dassler | 36/32 R |
| 4,375,728 | A | | 3/1983 | Dassler | |
| 4,404,759 | A | | 9/1983 | Dassler | |
| 4,541,185 | A | | 9/1985 | Chou | |
| D281,032 | S | | 10/1985 | Austin | |
| D284,616 | S | | 7/1986 | Gamm | |
| D292,142 | S | | 10/1987 | Tonkel et al. | |
| D316,627 | S | | 5/1991 | Schneider | |
| 5,168,643 | A | | 12/1992 | Laurain | |
| D332,862 | S | | 2/1993 | Kiyosawa et al. | |
| 5,203,792 | A | | 4/1993 | Kaiser | |
| D335,572 | S | | 5/1993 | Peterson | |
| D346,480 | S | | 5/1994 | Davidson | |
| 5,367,793 | A | * | 11/1994 | Deacon et al. | 36/127 |
| D356,885 | S | | 4/1995 | Poole, Jr. | |
| D359,385 | S | | 6/1995 | Meraw | |
| D362,745 | S | | 10/1995 | Skrivanek | |
| D366,952 | S | | 2/1996 | Pyle | |
| D370,993 | S | | 6/1996 | Mangee | |
| D373,896 | S | | 9/1996 | Parker | |
| D389,995 | S | | 2/1998 | Cockrell | |
| D390,693 | S | | 2/1998 | Curley | |
| D394,342 | S | | 5/1998 | Schneider | |
| 5,768,801 | A | | 6/1998 | Huff | |
| D401,743 | S | | 12/1998 | Wunsch | |
| D402,451 | S | | 12/1998 | Wunsch | |
| 5,848,482 | A | * | 12/1998 | Bathum | 36/127 |
| D405,944 | S | | 2/1999 | Sessa | |
| 5,887,371 | A | * | 3/1999 | Curley, Jr. | 36/127 |
| D412,239 | S | | 7/1999 | Sorofman | |
| 5,918,385 | A | | 7/1999 | Sessa | |
| D412,394 | S | | 8/1999 | Loveder | |
| D414,317 | S | | 9/1999 | Lubart | |
| 6,023,860 | A | | 2/2000 | McMullin | |
| D424,793 | S | | 5/2000 | Lubart | |
| D433,792 | S | | 11/2000 | Cockrell | |
| D437,989 | S | | 2/2001 | Cass | |
| D445,243 | S | | 7/2001 | Cockrell | |
| D446,912 | S | | 8/2001 | Cockrell | |
| D446,914 | S | | 8/2001 | Cockrell | |
| D446,915 | S | | 8/2001 | Cockrell | |
| D446,916 | S | | 8/2001 | Cockrell | |
| D447,326 | S | | 9/2001 | Cockrell | |
| D459,866 | S | | 7/2002 | Gan | |
| D463,901 | S | | 10/2002 | Adams et al. | |
| D468,079 | S | | 1/2003 | DeGrand et al. | |
| D468,517 | S | | 1/2003 | Recchi et al. | |
| D469,948 | S | | 2/2003 | Lin | |
| D470,650 | S | | 2/2003 | Lin | |
| D470,999 | S | | 3/2003 | Schroeder et al. | |
| D481,855 | S | | 11/2003 | Yang | |
| D483,554 | S | | 12/2003 | Burg et al. | |
| D483,934 | S | | 12/2003 | Adams et al. | |
| D487,333 | S | | 3/2004 | Laska | |
| 6,834,446 | B2 | | 12/2004 | McMullin | |
| D513,359 | S | | 1/2006 | McMullin | |
| 7,146,752 | B2 | * | 12/2006 | Pasternak et al. | 36/59 R |
| 2002/0144438 | A1 | | 10/2002 | Better | |

FOREIGN PATENT DOCUMENTS

| | | |
|---|---|---|
| FR | 2 415 436 | 8/1979 |

OTHER PUBLICATIONS

"Shoe Safety. FootstarWorks Occupational Footwear," http://www.footstarworks.com/occapps/shoeTech.jhtml;jsessionid=MFFJ1LIPK5S5HQFI, 3 pages (Date Printed Jul. 7, 2004).

"SlipGrips.com," http://www.slipgrips.com/occupation_index.cfm?occupationname=health, 1 page (Date Printed Jul. 7, 2004).

"Slip Resistant Footwear Introduced at NRA Trade Show." http://www.dfmg.com.tw/member/news/texwatch/010620/a8.htm, 2 pages (Jun. 20, 2001).

"TX Traction Shoes—TX Traction Boots—tx traction athletic shoes," http://www.famousfootwear.com/shop.asp?shopid=TX&, 2 pages (Copyright 2004).

* cited by examiner

FOOTWEAR OUTSOLE INCLUDING STAR SHAPES

CROSS REFERENCE TO RELATED APPLICATION

This application is a continuation of application Ser. No. 10/903,892, filed Jul. 30, 2004, now U.S. Pat. No. 7,146,752 which application is incorporated herein by reference.

BACKGROUND OF THE INVENTION

1. Field of the Invention

The present invention generally relates to footwear soles, and more particularly relates to footwear outsoles and tread constructions for footwear outsoles.

2. Related Art

According to the U.S. Bureau of Labor Statistics, slip and fall accidents are the second leading personal injury incident and second cause of accidental death in the United States. For the approximately 10 million work force in the food and preparation serving industry, as reported by the Bureau of Labor Statistics, these incidents represent about 65% of all lost time accidents among employees and more than 50% of all falls are caused by a slippery walking surface. By wearing footwear that includes slip resistant soles, some types of workers can minimize the risk of slip and fall accidents.

The slip resistance of a footwear can be tested using ASTM F1677-96 testing methods. These testing methods utilize the Brungraber Mark 11 testing, which applies both horizontal and vertical forces to a footwear sole simultaneously, resulting in a more thorough slip resistance measurement. These testing methods are well recognized throughout the United States and many other parts of the world.

The focus of the Brungraber testing is to measure the slip resistance of a footwear on dry, wet, and oily/wet surfaces. The tests are conducted on a 4-inch square section of American Olean red quarry tile as a test surface. To generate a slippery surface, testing labs use 0.05 grams (2 drops) of vegetable oil for the oily test. For the oily/wet test, 25 militers of water is added to the 0.05 grams of vegetable oil. A second test uses 0.2 grams (7 drops) of vegetable oil for the oily test with 25 militers of water added for the oily/wet testing. There are also dry tests and wet tests performed on the tile surface.

The slip resistance of a footwear can be affected by both the tread design and the materials of the footwear outsole. A footwear with improved slip resistant properties using tread design, materials, or a combination of tread design and materials would be an advance in the art.

SUMMARY OF THE INVENTION

The present invention generally relates to footwear outsoles and tread members for a footwear. One aspect of the invention relates to a footwear outsole that includes a base portion defining a tread attachment surface, and a plurality of tread members. The tread members are coupled to the tread attachment surface and protrude away from the tread attachment surface to define a tread member height. Each tread member includes a plurality of pointed arm members that extend away from a center portion of the tread member in a direction substantially parallel to a plane of the attachment surface. The arm members include a pointed tip that defines a maximum height of each tread member.

Another aspect of the invention relates to a footwear that includes an upper and an outsole coupled to the upper. The outsole includes an array of projections extending generally downward from the outsole. Each projection includes at least three pointed arms extending from a center portion of the projection in a direction substantially perpendicular to the direction in which the projection extends from the outsole. Each projection includes a downward facing primary surface defined in part by the pointed arms. The primary surface is configured to engage a ground surface and includes a recess formed therein.

A further aspect of the invention relates to a method of manufacturing a footwear sole. The method may include forming a base member that defines a mounting surface, forming a plurality of tread members, and coupling the tread members to the mounting surface. Each tread member includes a plurality of pointed arm members that extend from a center of the tread member in the plane of the mounting surface. The tread members may also include an outermost surface facing away from the mounting surface. The outermost surface includes a recess from tips of the pointed arm members toward a center of the tread member.

A still further aspect of the invention relates to a sole tread member that includes a base portion and a plurality of generally pointed arm members extending laterally from a center portion of the base portion. The base portion and arm members define an outward facing primary surface. The primary surface includes a recess and a plurality of edges that define a circumference of the recess.

Another aspect of the invention relates to a footwear outsole that includes a base portion defining a tread attachment surface, and a plurality of tread members coupled to the tread attachment surface. Each tread member includes a plurality of arm members that define a star shaped cross section. The cross section is taken in a direction parallel to a plane of the tread attachment surface. The tread members also include a primary surface facing away from the tread attachment surface. Each arm member includes a tip defined by an acute angle portion of the arm. The tips of the plurality of arm members defining a portion of the tread member extending furthest from the tread attachment surface.

A further aspect of the invention relates to a footwear outsole that includes a base portion having a tread attachment surface, and a plurality of tread members coupled to the tread attachment surface. Each tread member includes a plurality of pointed arms extending from a center portion of the tread member in a direction substantially perpendicular to the direction in which the tread member extends from the outsole. The plurality of tread members are positioned on the tread attachment surface at spaced apart locations from each other across an entire width of the base portion.

A still further aspect of the invention relates to a footwear outsole that includes a base portion defining a tread attachment surface, and a plurality of tread members coupled to the tread attachment surface. The tread members protrude away from the tread attachment surface, and each tread member includes a plurality of pointed arm members having an acute angle defining a point of each arm member. The tread members also include a recess formed in a primary surface of the tread member, the primary surface facing away from the tread attachment surface. The tread members may be aligned in diagonal rows relative to a longitudinal centerline of the outsole.

The above summary of the present invention is not intended to describe each disclosed embodiment or every implementation of the present invention. Figures in the detailed description that follow more particularly exemplify certain embodiments of the invention. While certain embodiments will be illustrated and describe embodiments of the invention, the invention is not limited to use in such embodiments.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to footwear outsoles and tread constructions for footwear that provide improved slip resistant properties. An example tread construction according to the principles of the invention includes a plurality of tread members that protrude from a base member of the footwear outsole. The tread members include several pointed arm portions that extend laterally (a direction generally perpendicular from a direction in which the tread members protrude from the base member) from a center portion of the tread member to define a star-shape cross-section. The tread members also define a primary surface using the arm portions, wherein the primary surface faces generally downward and away from the base member of the footwear outsole. The aggregate primary surfaces of the plurality of tread members define a bottom surface of the footwear that has spaces between the tread members.

The arm portions of each tread member also define a plurality of edges and pointed tips that provide additional "gripping" of the tread members to a ground surface. The edges and pointed tips may be useful for directing fluid away from the tread member primary surface. The edges and pointed tips may also provide point and line contact areas between the footwear outsole and a ground surface that enhance the slip resistance of the footwear as compared to a surface contact between the ground surface and the footwear outsole.

The primary surface defined by each tread member may include a concave, cup-like shape that provides a "suction" effect that may further improve the slip resistance of the footwear. The tread constructions described herein may comprise a variety of different materials that also enhance the slip resistance of the footwear when combined with either or both of the star shapes and concave surface features of the tread construction.

Figure 1:
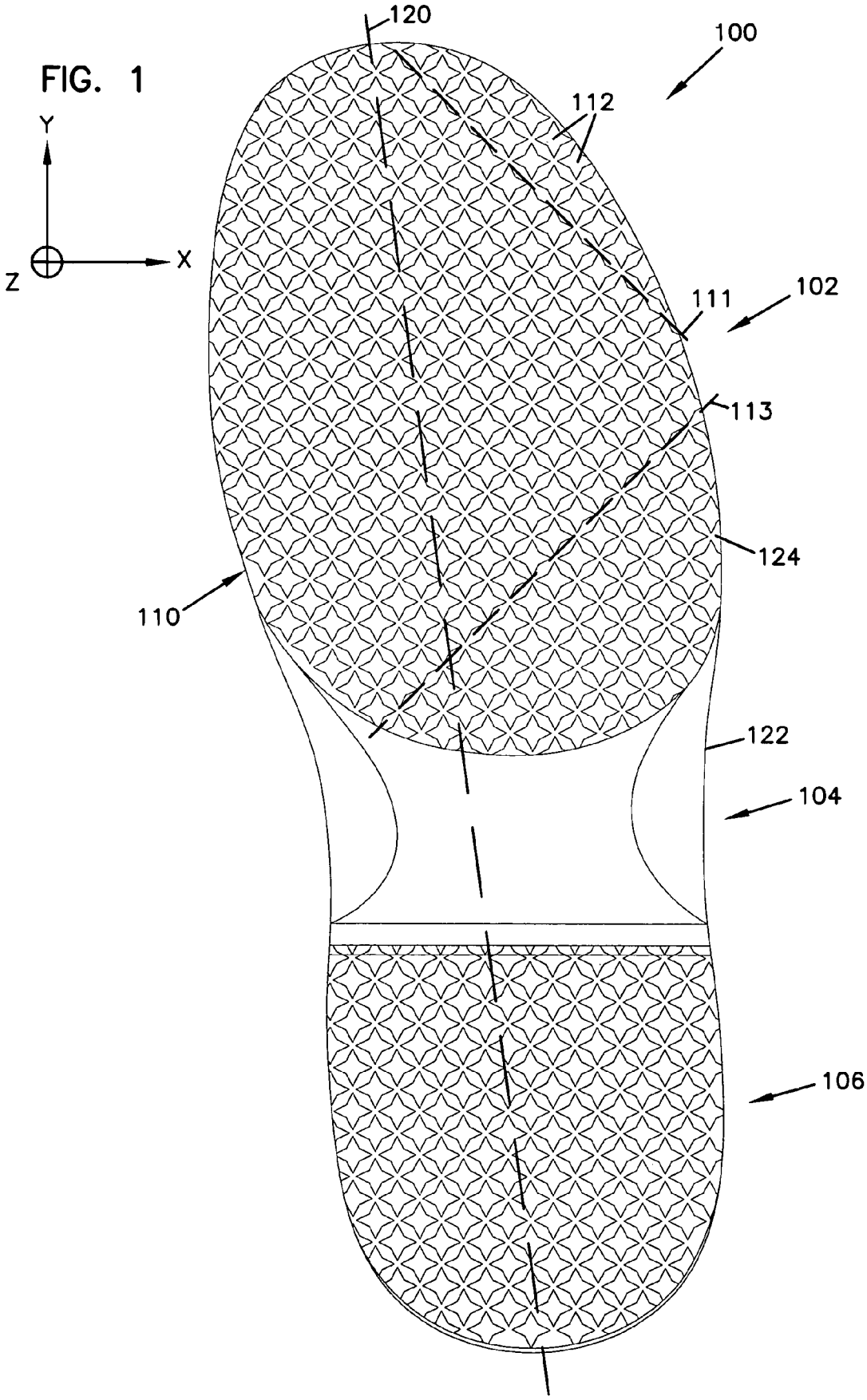
FIG. 1 is a bottom plan view of an example footwear sole member according to principles of the invention.
Figure 2:
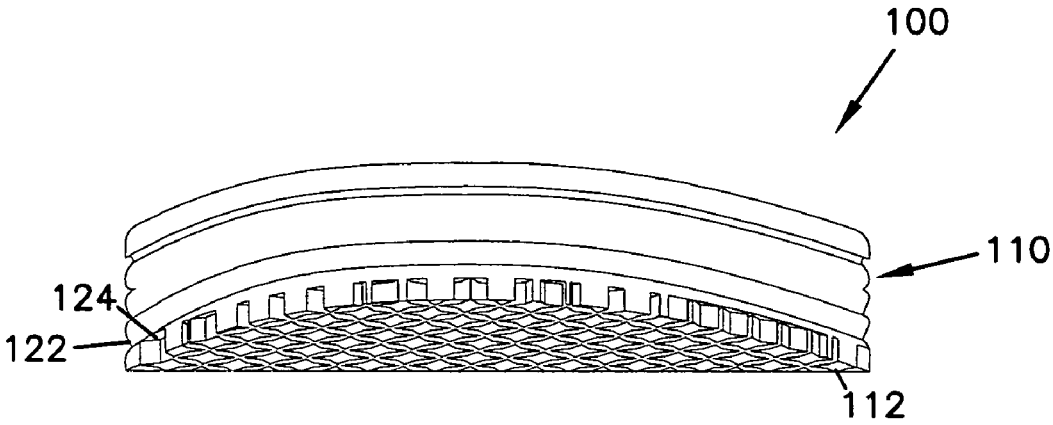
FIG. 2 is a front view of the footwear sole member shown in FIG. 1.
Figure 3:
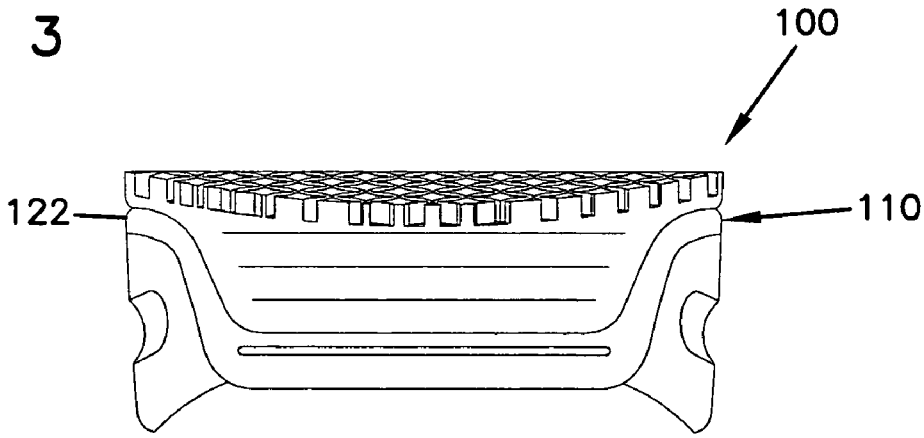
FIG. 3 is an end view of the footwear sole member shown in FIG. 1.
Figure 4:
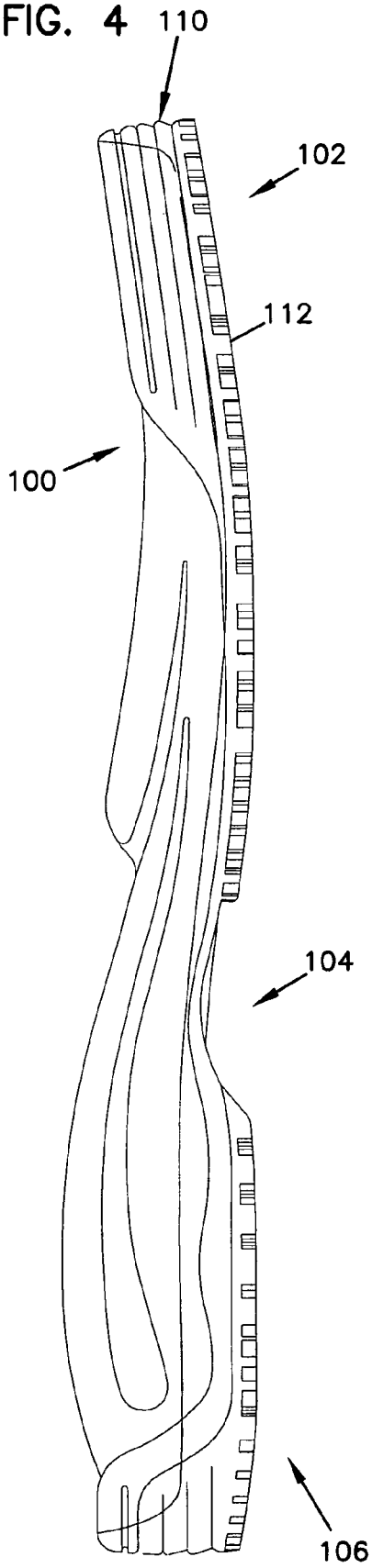
FIG. 4 is a side view of the footwear sole member shown in FIG. 1.
Figure 5:
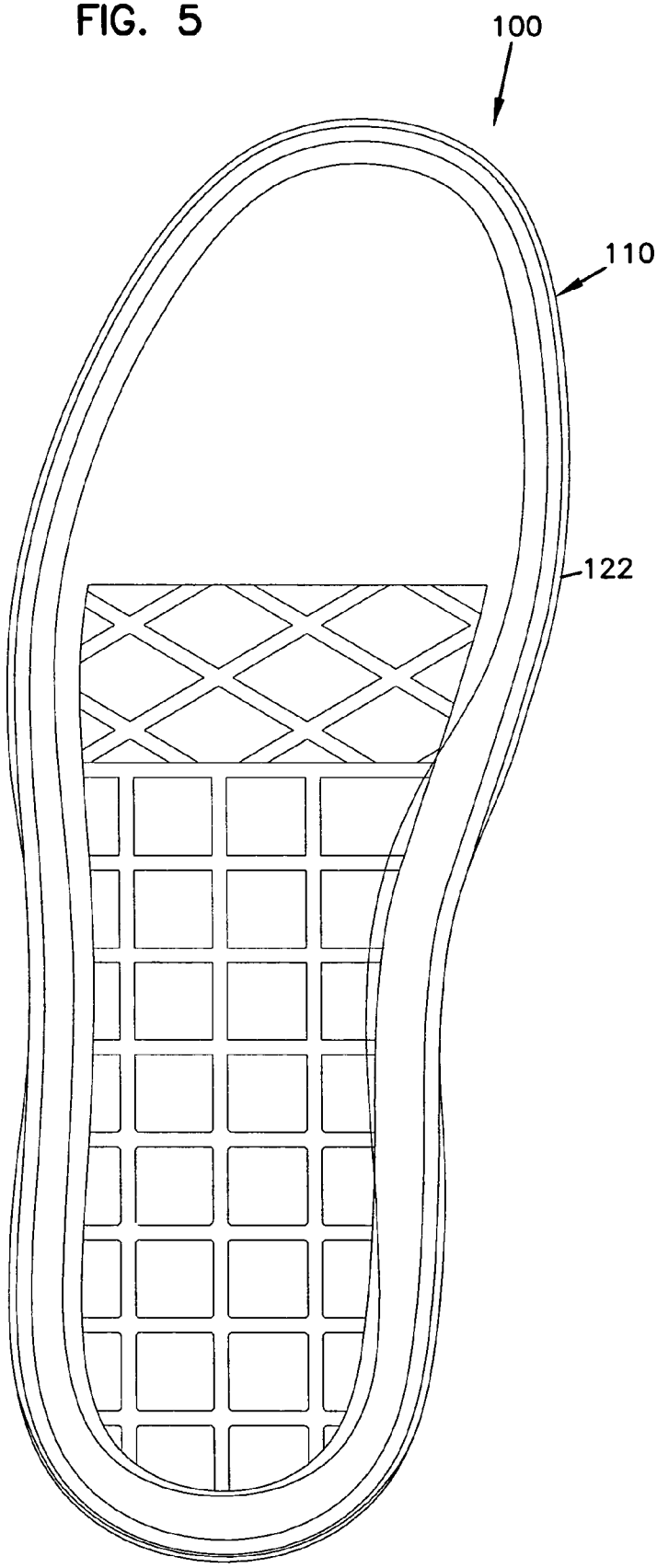
FIG. 5 is a top plan view of the footwear sole member shown in FIG. 1.

The term "star shaped" as used herein is defined as any shape having at least two generally pointed arm portions that extend laterally outward from a center point. The resulting star shape may give the appearance of a multi-pointed star. Referring to FIG. 1, arms of a tread member 112 may extend laterally from a center point in the XY plane while the tread member 112 as a whole protrudes from the tread attachment surface 224 in the Z direction. A star shape may include arms extending symmetrically from a center point or asymmetrically from a center point. The arms may also have different sizes and shapes. An example shape includes an acute angle shape.

A concave and recessed surface as used herein is defined as any surface having a form that bulges inward. An example recessed surface resembles the interior of a portion of a sphere. Concave and recessed surfaces as used herein may include linear rather than curved portions. Preferably, concave and recessed surfaces as defined herein are any generally concave shaped surfaces that are recessed relative to a reference point such as a primary surface. A "footwear" as used herein is defined as any type of wear suitable for use on a foot such as, for example, a shoe, boot, sandal, overshoe, etc. The term "outsole" as used herein is defined as any layer or member of a footwear that defines in part an outermost bottom facing surface of a footwear.

Slip resistant tread constructions for footwear outsoles may include a plurality of tread projections having a circular, rectangular or triangular cross section. Each of these shaped tread members include several edges that define an edge length for the tread member. The tread members also typically define contact surfaces for contacting a ground surface. Further, when positioning several tread members relative to each other the tread members may define channels for directing fluids out from under the outsole or away from the contact surface. The tips and edges of the tread arms and the channel features may help improve the slip resistance of the tread construction.

An example footwear outsole 100 is shown and described with reference to FIGS. 1-5. The outsole 100 includes forefoot, midfoot, and hindfoot sections 102, 104, 106, a base outsole member 110, and a plurality of tread members or lugs 112. The base member 110 defines a periphery 122 of the footwear 100, and a mounting or tread attachment surface 124 to which the plurality of tread members 112 are coupled. The tread members 112 are positioned in an array of rows and columns that extend diagonally from a longitudinal axis 120. The tread members 112 are also slightly offset from each other so as to define diagonally extending channels (see dashed lines marked 111, 113 in FIG. 1) in alignment with the rows and columns of tread members 112 as shown in FIG. 1.

Other embodiments may include rows and columns of tread members that are aligned in parallel or perpendicular alignment with the axis 120, or at any diagonal angle desired.

In further embodiments, the tread members may be aligned in curved rows or columns along the length or across a width of certain portions of the outsole. In yet further embodiments, the tread members may be positioned at random locations on the outsole rather than in rows or columns. Still further, the tread members of a single footwear may have many different sizes and shapes. For example, different tread sizes may be positioned to correspond with certain anatomical features of a user's foot.

Referring now to FIGS. 9-12, an example single tread member 112 is shown in further detail. Each tread member includes first, second, third and fourth arms 132, 134, 136, 138, wherein each arm includes first and second edges 140, 142 and a tip 144. The arms 132, 134, 136, 138 are coupled to a core or central portion 130. In this embodiment, core 130 is square-shaped and each of the arms 132, 134, 136, 138 is triangular in shape. Other embodiments may include arms that are directly coupled to each other wherein no core piece is required. Further embodiments may include arms that have different shapes such as rectangular or polygonal shapes, or shapes that include one or more curved sides.

The edges 140, 142 of each arm are shown coupled to each other as a continuous edge. The continuous periphery edge surface defined by the arms 132, 134, 136, 138 has a length that is greater than a periphery edge surface of a square-shaped tread member having four side edges that extend between corners of the square (see the dashed lines 151 in FIG. 22). Furthermore, the edges 140, 142 of each arm 132, 134, 136, 138 provide a total number of edges (eight edges for tread 112) that is greater than the number of edges for the square shaped tread 151, a triangle shaped tread (not shown) that includes three edge sections, or a circular shaped tread (not shown) that includes a single, continuous edge. A tread member with more than four edge sections may provide improved slip resistance as compared to a tread member with four or fewer edge sections.

Figure 13:
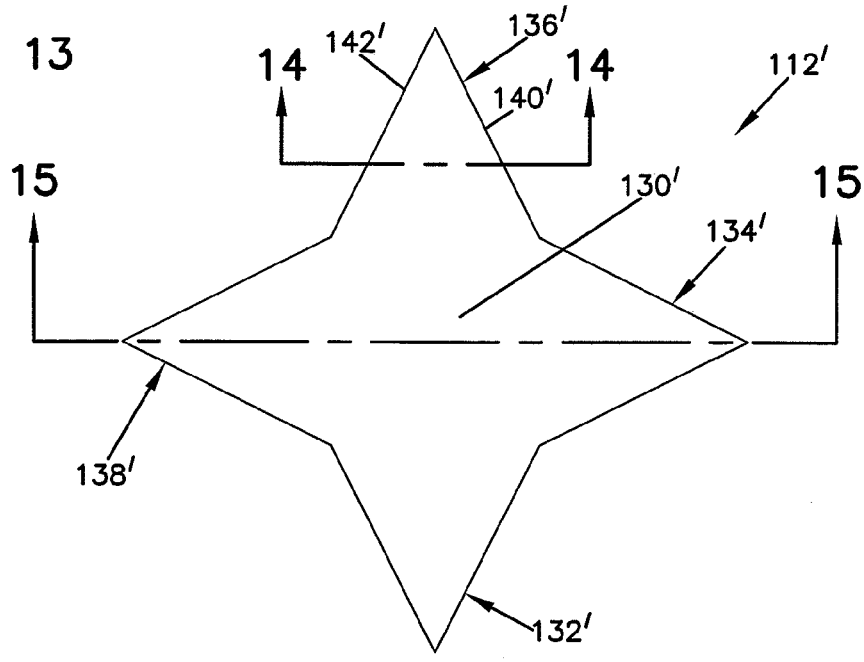
FIG. 13 is a plan view of another example tread member according to the principles of the present disclosure.
Figure 14:
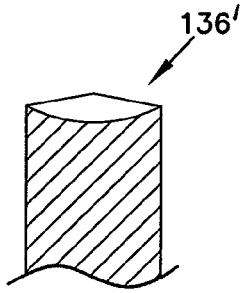
FIG. 14 is a cross-sectional view of an arm of the tread member shown in FIG. 13 taken along 14-14.
Figure 15:
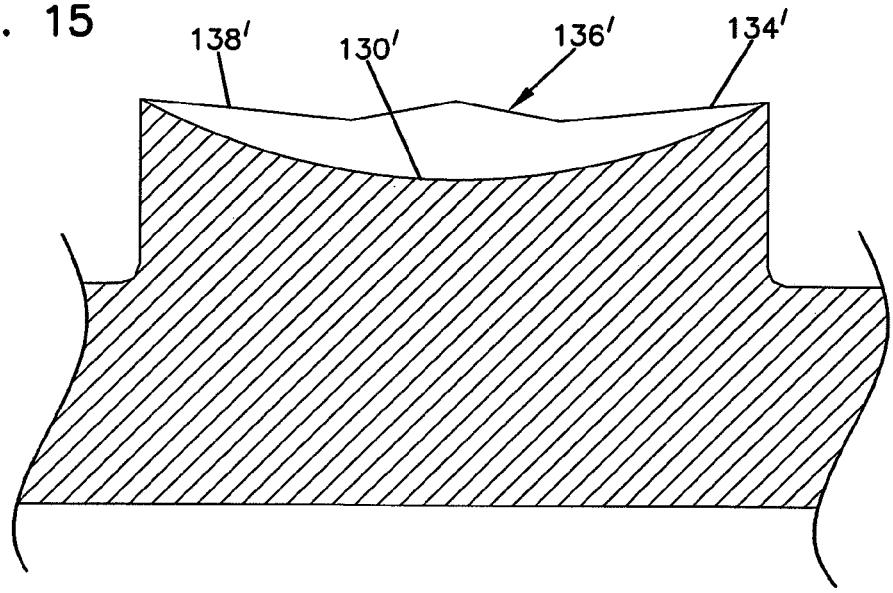
FIG. 15 is a cross-sectional view of an arm of the tread member shown in FIG. 13 taken along 15-15.

The tread member 112 also includes a concave or recessed surface as shown in FIGS. 9-12. The concave surface is formed in the contact surface 146. The contact surface 146 is defined by top surfaces of the core 130 and arms 132, 134, 136, 138. The concave feature extends from the tip 144 of each arm towards the core 130. In some embodiments, the edges 140, 142 may also recess from the tip 144 towards a center of core 130. In other embodiments, the edges 140, 142 are all generally coplanar with the tips 144. The top surfaces of the arms 132, 134, 136, 138 may be flat, slanted or curved between the edges 140, 142. See FIGS. 13 and 14 showing an embodiment of a tread member 112' where the top surfaces of arms 132' are curved between edges 140', 142'. The top surfaces of the arms 132, 134, 136, 138 may be flat, slanted or curved from the edges 140, 142 towards the recessed top surface of core 130. See FIGS. 13 and 15 that show that the top surfaces of the arms 132', 134', 136', 138' of the tread member 112' are also curved towards the recessed top surface of the core 130'. In other embodiments, the top surface of the arms 132, 134, 136, 138 may be relatively flat and not include a recess while the top surface of the core 130 includes a recessed feature with a slanted or curved portions in a transition area between the top surface of arms 132, 134, 136, 138 and the top surface of core 130.

The concave/recessed feature of the primary surface 146 may provide several advantages related to slip resistance. One advantage of the concave/recessed feature is that it isolates the tip 144 and edges 140, 142 vertically from the core 13. As a result, the first contact between a ground surface and the tread member 112 (the application of forces in the directions P and T shown in FIG. 10) is at the tips 144, along the multiple edges 140, 142, or upon the surface area of the arms 132, 134, 136, 138 between the edges 140, 142 before contact with contact with the large outer facing surface the core 130. Another advantage of including a recessed primary surface 146 surrounded by edges 140, 142 and tips 144 is that foreign materials such as water or oil that would otherwise build up between the tread member 112 and the ground surface can be transferred into the recessed portion of the contact surface 146. Directing foreign materials away from the portion of the tread member that first contact a ground surface may improve slip resistance.

The recess of the primary surface 146 may be recessed a depth of about 0.1 mm to about 2 mm, more preferably depth of about 0.1 mm to about 0.5 mm, and most preferably about 0.3 mm. The depth D of the recess is measured from an outer most point of the tread to the lowest depth of the recess (see FIG. 10). The tread members 112 have a height H from the tread mounting surface 124 to an outermost point of the tread member (the point 144) of about 0.5 mm to about 5 mm, more preferably about 1 mm to 3 mm, and more preferably about 2.5 mm. The width W of the tread member measured from one tip 144 of one arm member to an opposing tip 144 may be less than about 20 mm, more preferably between about 5 mm to about 15 mm, and most preferably about 7 mm to about 9 mm. Other sizes for the depth D, height H, and width W than those listed above may be possible.

The number of tread members 112 on a give footwear outsole may vary. In one example, the outsole includes at least ten tread members in each of the forefoot and hindfoot portions 102, 106, an more preferably includes about 50 to 200 tread members in each of the forefoot and hindfoot portions 102, 106. In another example, the footwear outsole includes at least 100 tread members total.

Referring again to FIG. 1, the sole member 100 includes tread members 112 in the forefoot and hindfoot sections 102, 106, but not in the midfoot section 104. The midfoot section 104 includes a heel breast portion of the outsole base 110 that defines a recess that is typically not intended to make contact with a ground surface when the footwear is used on a generally flat ground surface. In other embodiments, the tread members 112 may extend into the mid sole section 104 depending on the shape and design of the sole member. In still further embodiments, the tread members 112 may not extend to the outer periphery 122 of the sole member. For example, a strip of material may be positioned adjacent the tread members 112 so as to define a boundary between the periphery 122 and the tread members 112.

In other embodiments, the sole member 100 may include only a few tread members that are clustered together at specific locations on the base portion 110 such as, for example, in discrete areas aligned with certain portions of a user's foot. In still further embodiments, individual star members may be positioned separately at desired locations across the base portion mounting surface 124 and may be combined with other tread member configurations and outsole features.

Figure 6:
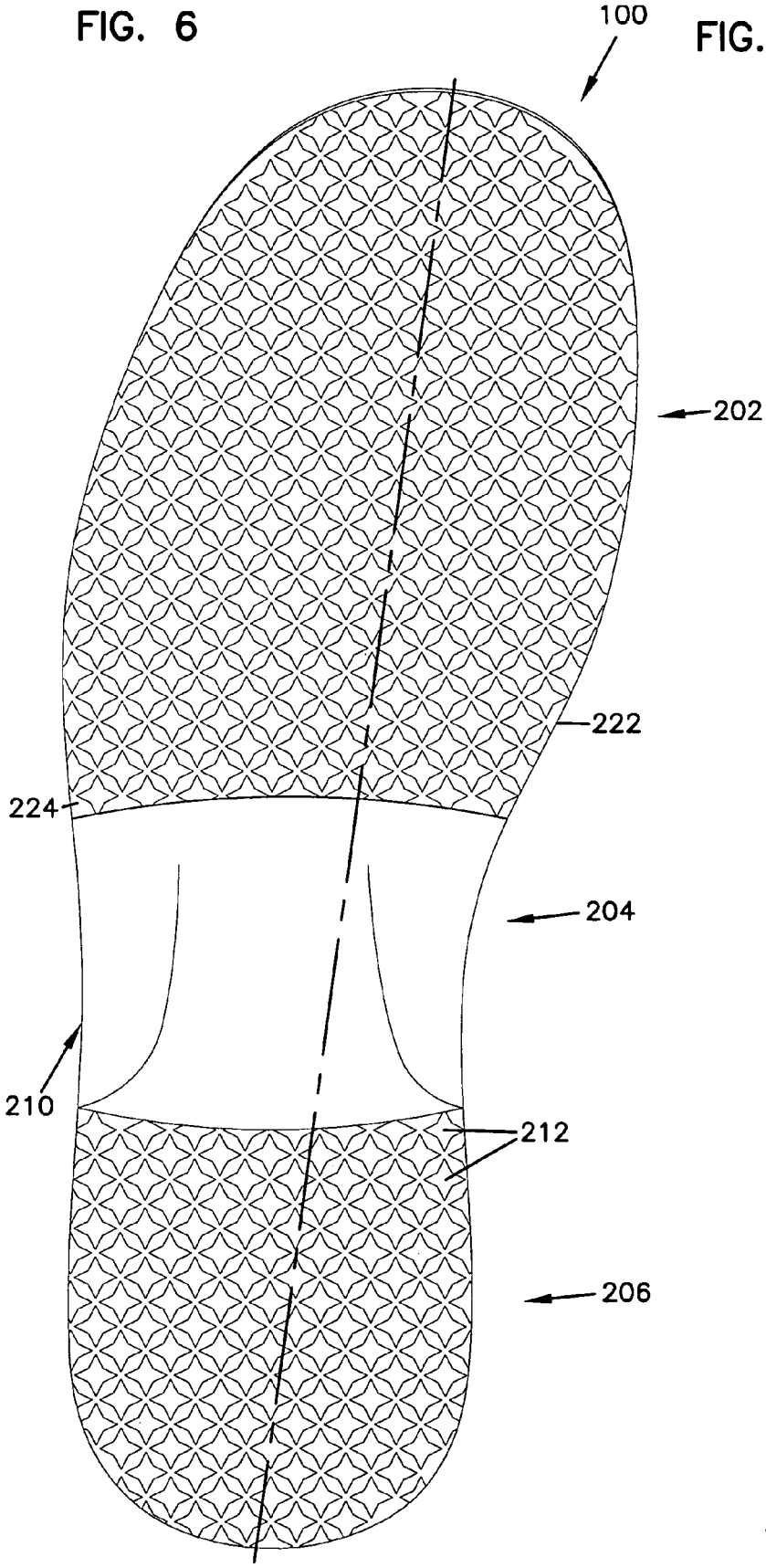
FIG. 6 is a bottom plan view of another example footwear sole member according to principles of the invention.
Figure 7:
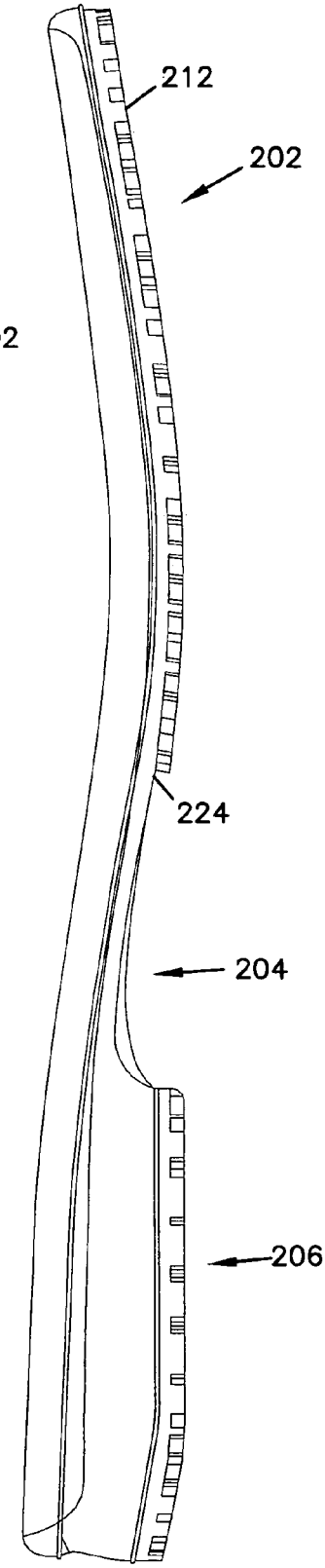
FIG. 7 is a side view of the footwear sole member shown in FIG. 6.
Figure 8:
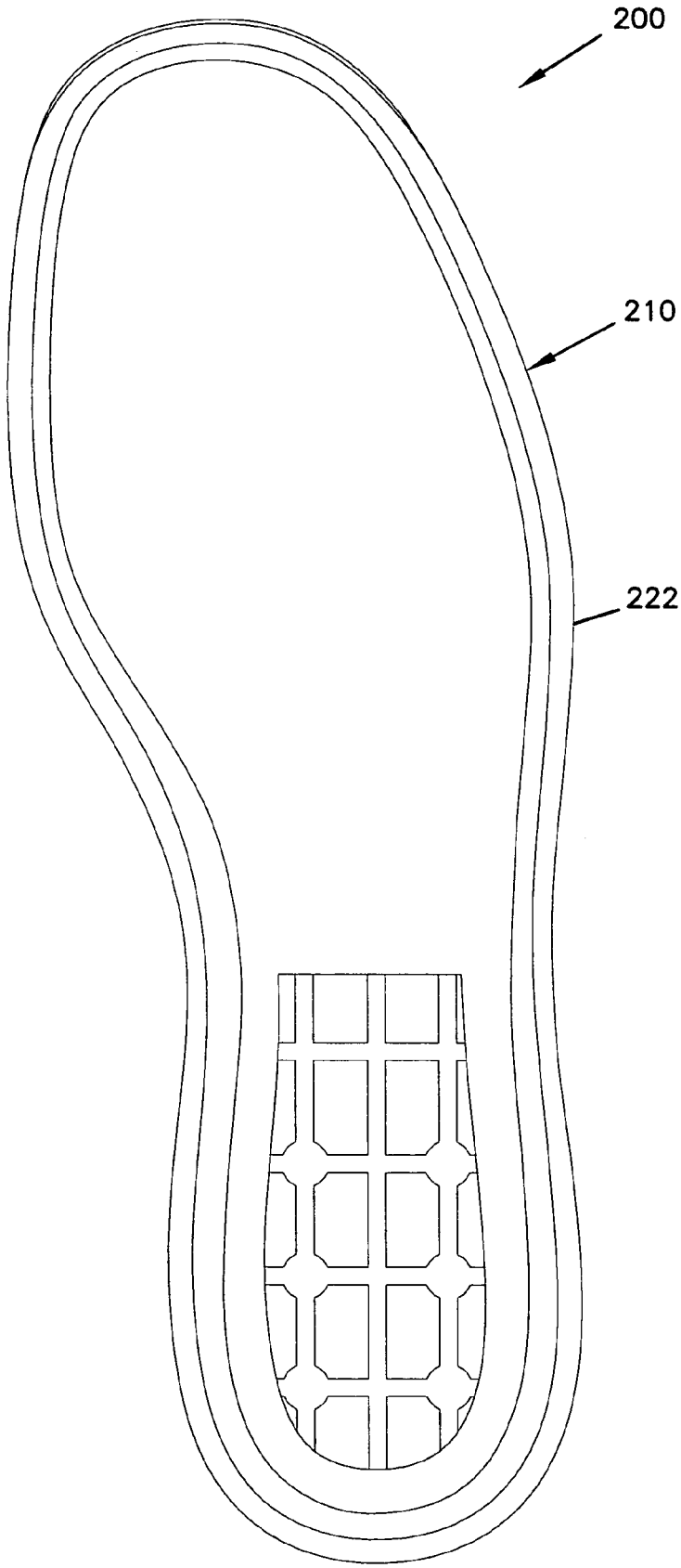
FIG. 8 is a top plan view of the footwear sole member shown in FIG. 6.
Figure 12:
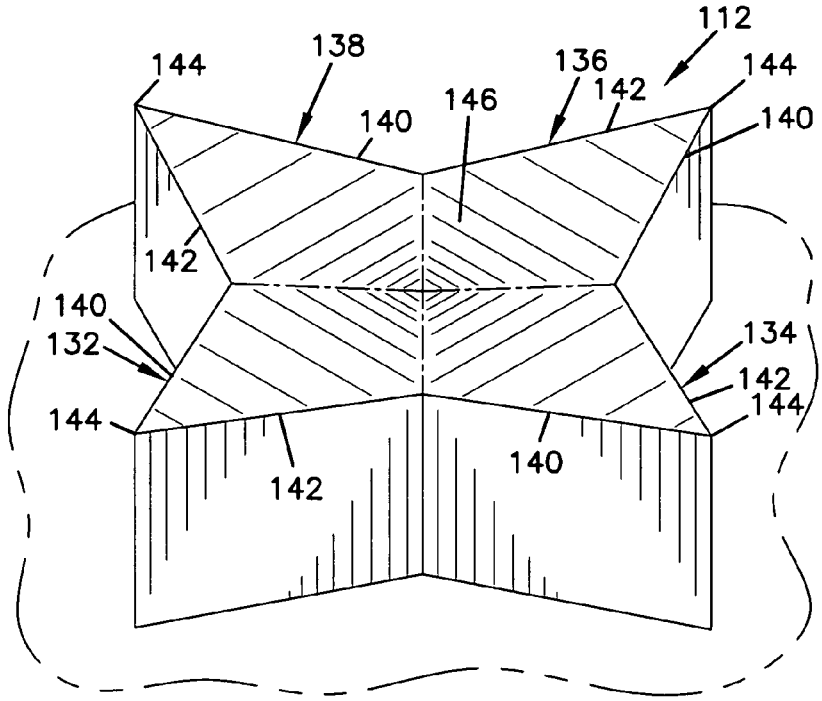
FIG. 12 is a perspective view of the tread member shown in FIG. 9.
Figure 9:
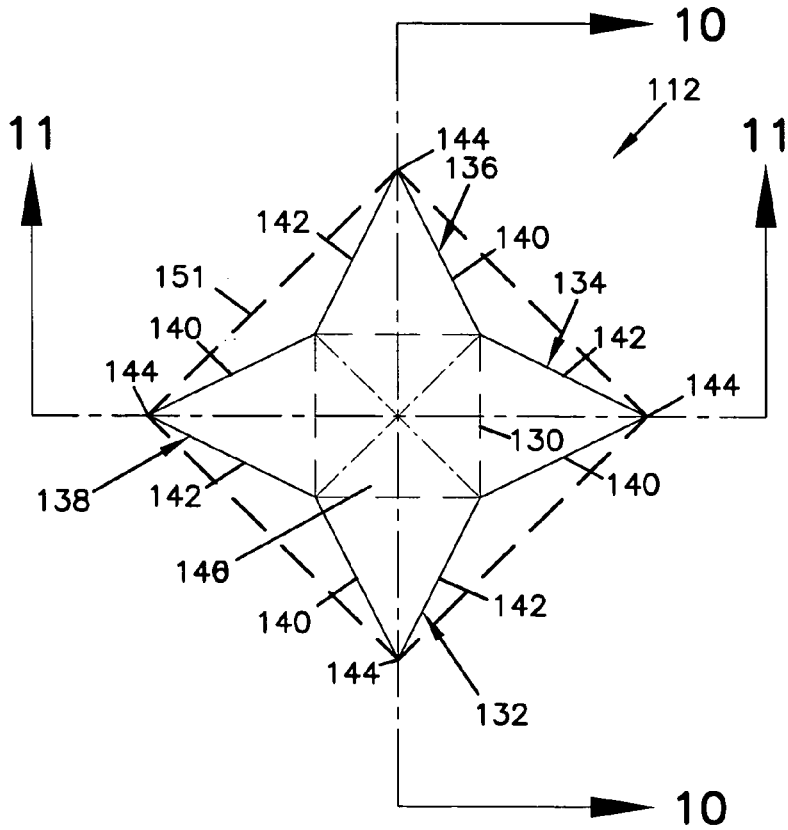
FIG. 9 is a plan view of an example star-shaped tread member according to principles of the present invention.
Figure 10:
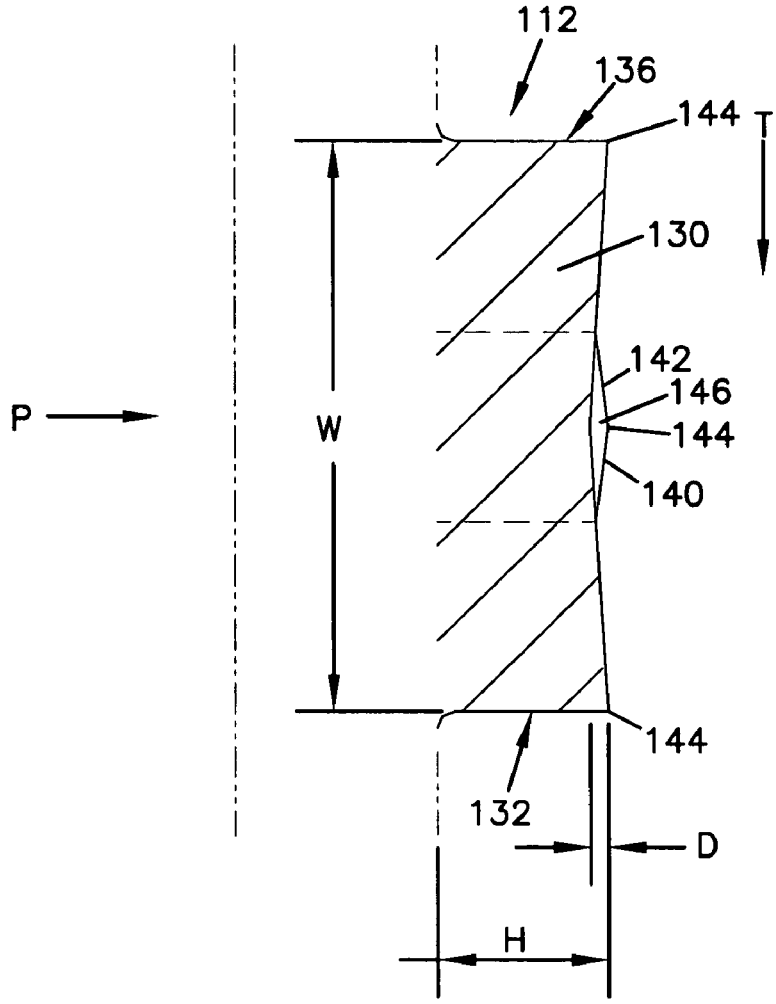
FIG. 10 is a cross-sectional view of the tread member shown in FIG. 9 taken along cross-sectional indicators 10-10.
Figure 11:
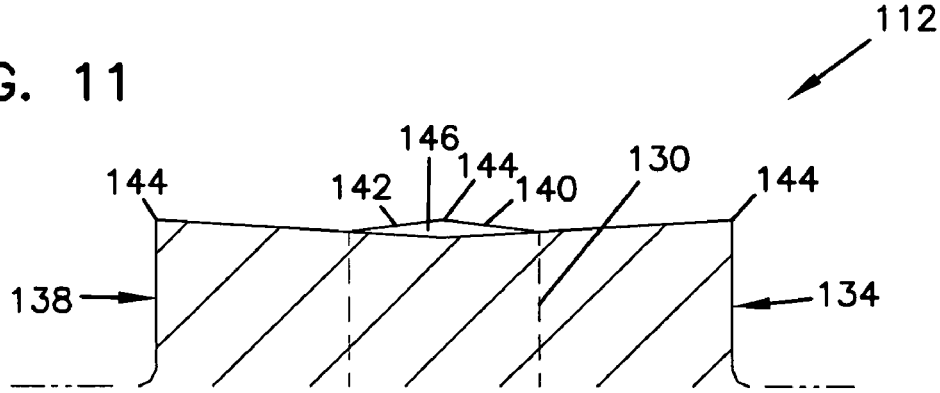
FIG. 11 is a cross-sectional view of the tread member shown in FIG. 9 taken along cross-sectional indicators 11-11.

Referring now to FIGS. 6-8, a further example footwear sole member 200 is shown and described. Sole member 200 includes forefoot, midfoot and hindfoot portions 202, 204, 206, a base portion 210 and a plurality of tread members 212. The base member includes a longitudinal axis 220, a periphery 222, and a mounting surface 224. Each tread member 212 may include a core portion and a plurality of arms that each define first and second edges and a tip as described above with reference to sole member 100. The tread members 212 may also define primary outward facing surfaces having a concave/recessed portion as described above with reference to tread members 112.

One difference between sole member 100 and sole member 200 is the shape of the forefoot and hindfoot sections 202, 206 and the size of the tread members 212 as compared to tread members 112. Another difference between sole member 100 and sole member 200 is the structure of the midfoot section 204 as compared to midfoot section 104. A still further difference between sole members 100, 200 is the structure of the base portion 210 that extends in a direction opposite the mounting surface 224. The differences between base portion 110 and base portion 210 illustrate that many different base portion configurations can be used in combination with the star shaped tread members 112, 212.

The sole features described above may be constructed using a variety of different method such as, for example, molding or casting. Different portions of the sole such as the tread members and the base portion of the sole that the tread members are secured to may be formed separately using any desired method or process and then later secured together using a connecting method such as, for example, adhesives or heat welding. In one embodiment, the base portion of the sole and the tread members are molded together in a single step using, for example, injection molding. In another embodiment, the tread members are molded onto the base portion or vice versa. The sole features described above may include different materials or combinations of materials to provide desired slip resistant properties. Some example materials includes natural rubber, synthetic rubber such as nitrile, styrene butandiene, and butyl, polyurethanes such as polyester and polyether, thermoplastic rubber, thermoplastic urethane, or combinations of these materials. In some embodiments, the tread members may include different materials than the base portion of the sole that the tread members are secured to. In other embodiments, the tread members themselves may includes different materials. For example, different tread members on a single footwear sole may include different materials to meet certain objectives for a specific portion of the sole (e.g., the heel strike area versa the forefoot area of the sole). In another example, a single tread member may include different layers of materials that are constructed by, for example, a layering molding process or by spraying a coating a layer onto a molded tread member.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A footwear outsole, comprising:

a tread attachment surface; and at least one tread member protruding from the tread attachment surface, the at least one tread member including at least three arm members, each of the at least three arm members including a pair of straight edges arranged at an acute angle relative to each other when viewing the at least one tread member from a direction perpendicular to the tread attachment surface;

wherein at least one of the arm members includes a concave contact surface defined between the pair of straight edges that faces away from the tread attachment surface, the concave contact surface between the pair of straight edges being recessed partially toward the tread attachment surface relative to the pair of straight edges.

2. The footwear outsole of claim 1, wherein the pair of straight edges intersect to define a pointed tip.

3. The footwear outsole of claim 1, wherein the at least one tread member includes at least four arm members, each of the at least four arm members including a pair of straight edges arranged at an acute angle relative to each other when viewing the at least one tread member from a direction perpendicular to the tread attachment surface.

4. The footwear outsole of claim 2, wherein the pointed tip defines a maximum height of the at least one tread member relative to the tread attachment surface.

5. The footwear outsole of claim 1, wherein each of the tread members includes a concave contact surface defined between the pair of straight edges that faces away from the tread attachment surface, the concave contact surface of each tread member being recessed partially toward the tread attachment surface relative to the pair of straight edges of that tread member.

6. The footwear outsole of claim 1, further comprising a plurality of tread members aligned in rows and columns on the tread attachment surface.

7. The footwear outsole of claim 1, wherein the at least one tread member includes first and second planar side surfaces arranged perpendicular to the tread attachment surface, and each of the planar side surfaces extends from the tread attachment surface to one of the straight edges.

8. The footwear outsole of claim 1, wherein at least one of the arm members is arranged in parallel with a longitudinal axis of the footwear outsole.

9. The footwear outsole of claim 1, wherein the acute angle is less than 60°.

10. A footwear outsole, comprising:

a tread attachment surface; and at least one tread member protruding from the tread attachment surface, the at least one tread member including a plurality of arm members, at least one of the arm members including a pair of straight edges arranged at an acute angle relative to each other when viewing the at least one tread member from a direction perpendicular to the tread attachment surface, the at least one tread member including a concave contact surface defined between the pair of straight edges that faces away from the tread attachment surface, the concave contact surface between the pair of straight edges being recessed partially toward the tread attachment surface.

11. The footwear outsole of claim 10, wherein each of the plurality of arm members includes a concave portion that is recessed partially toward the tread attachment surface.

12. The footwear outsole of claim 10, wherein the plurality of arm members include a plurality of connected straight edges that define a periphery of the recess.

13. The footwear outsole of claim 12, wherein the pointed tip defines a portion of the at least one tread member that extends furthest away from the tread attachment surface.

14. The footwear outsole of claim 10, wherein the pair of straight edges intersect to define a pointed tip of the arm member.

15. The footwear outsole of claim 10, wherein the acute angle is less than 60°.

16. The footwear outsole of claim 10, wherein the at least one tread member includes at least three arm members, wherein at least three of the arm members each includes a pair of straight edges arranged at an acute angle relative to each other when viewing the at least one tread member from a direction perpendicular to the tread attachment surface.

17. The footwear outsole of claim 10, wherein the at least one tread member includes four tread arm members, wherein each of the arm members includes a pair of straight edges arranged at an acute angle relative to each other when viewing the at least one tread member from a direction perpendicular to the tread attachment surface.

18. A footwear outsole, comprising:

a tread attachment surface; and at least one tread member protruding from the tread attachment surface, the at least one tread member including at least three arm members and defining a concave contact surface facing in a direction away from the tread attachment surface, each of the at least three arm members including a pair of planar side surfaces, the planar side surfaces extending from the tread attachment surface to the contact surface in a direction substantially perpendicular to the tread attachment surface, wherein at least a portion of the concave contact surface is defined between the pair of planar side surfaces of at least one of the arm members, the at least a portion of the concave contact surface between the pair of planar side surface being recessed partially toward the tread attachment surface relative to edges where the pair of planar side surfaces and the concave contact surface meet.

19. The footwear outsole of claim 18, wherein the entire concaved contact surface is partially recessed toward the tread attachment surface.

20. A footwear outsole, comprising:

a tread attachment surface;

an array of tread members integrally molded to the tread attachment surface, wherein at least some of the tread members include at least three arm members extending from a core portion, wherein the core portion is located central to the arm members, wherein each arm member is directly connected to the tread attachment surface and extends away from the tread attachment surface, and wherein the core portion and the arm members of the tread members define a concave ground contact surface wherein the ground contact surface includes a continuous curve between the core portion and in the arm members.

21. The footwear outsole of claim 20, wherein the core portion includes a center portion and a periphery portion, and wherein the center portion is recessed relative to the periphery portion.

22. The footwear outsole of claim 21, wherein each arm includes a proximal end and a distal end, wherein the proximal end is connected to the center portion and the proximal end is recessed relative to the distal end.

* * * * *